United States Patent [19]

Chiavola et al.

[11] 4,020,968

[45] May 3, 1977

[54] CONTAINER RIM GUARD AND EXTENSION DEVICE

[76] Inventors: Victor Chiavola, 15 Hill Drive, Bohemia, N.Y. 11716; George Chiavola, 697 Heckscher Ave., Bayshore, N.Y. 11706; John Scott, 50 South Ave., Smithtown, N.Y. 11787

[22] Filed: Sept. 17, 1975

[21] Appl. No.: 614,075

[52] U.S. Cl. ..... 220/90; 222/570

[51] Int. Cl.[2] ..... B65D 25/20; B65D 47/40

[58] Field of Search ..... 220/4 A, 90; 222/570

[56] References Cited

UNITED STATES PATENTS

| | | | |
|---|---|---|---|
| 2,801,762 | 8/1967 | Atherton | 220/4 A |
| 2,873,052 | 2/1959 | Atherton | 220/90 |
| 2,873,881 | 2/1959 | Nichols | 220/4 A |
| 3,102,667 | 9/1963 | Ullevig | 220/90 |
| 3,309,000 | 3/1967 | Haverstick | 220/4 A |
| 3,463,366 | 8/1969 | Spencer | 222/570 |
| 3,469,735 | 9/1969 | Burt | 220/90 |

*Primary Examiner*—George E. Lowrance
*Attorney, Agent, or Firm*—Edith Grill

[57] ABSTRACT

A rim guard and extension device for disposal on and engagement with the rim of an open container comprising a tubular member provided at its lower end with an annular flange consisting of a vertical internal member for insertion into the container, a horizontal bridge member, a vertical external member for engagement with the bead on the outside of the container; and an upstanding flange extending from the outer edge of the annular flange which forms a catch basin therewith.

4 Claims, 3 Drawing Figures

FIG. 1
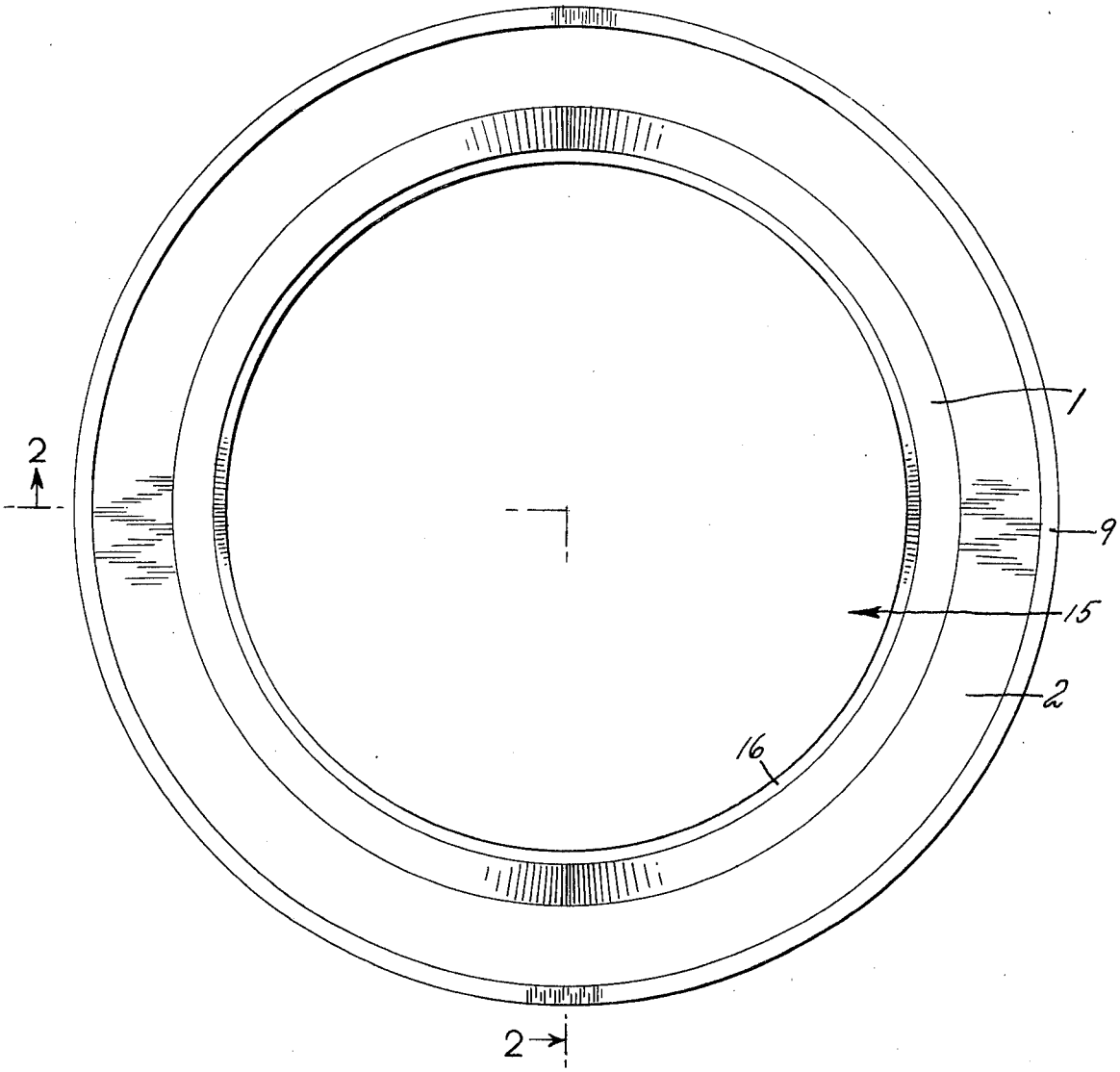
FIG. 2
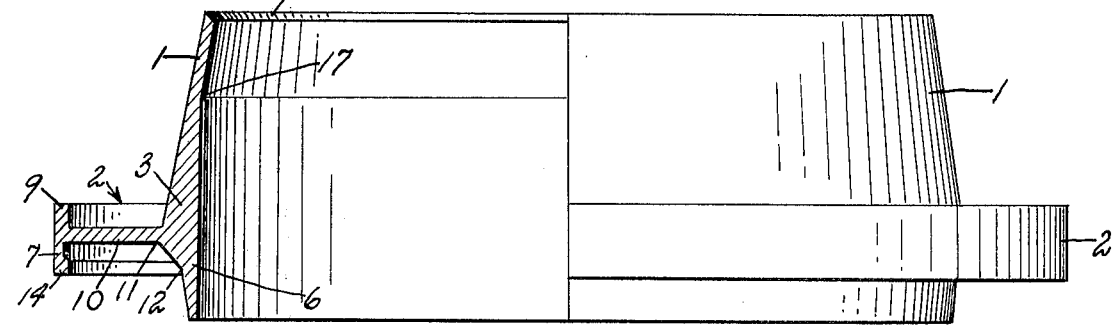
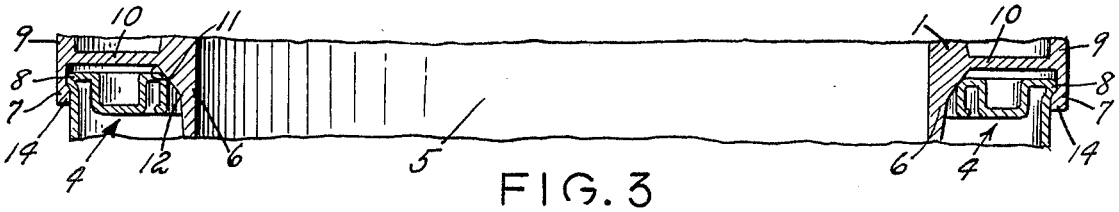
FIG. 3

CONTAINER RIM GUARD AND EXTENSION DEVICE

This invention relates to an attachment adapted to be removably secured to the rim of an open container such as a conventional paint can.

The use of containers with press-on lids which fit into grooved areas on the rim of said containers, such as conventional paint cans, has presented problems of long standing. In mixing the contents within the container, some liquid is bound to spill over the top into the groove and onto the sides of the can, even where the user exercises extreme care. This prevents the proper reapplication of the press-on lid, and if pressed down hard into the groove filled with liquid, some will spurt up at the user. In addition, the sides of the container become covered with paint which hardens and obliterates the printed material so that the user becomes unable to match the paint, both as to color (shade) and brand. Another common expedient utilized by painters which further aggravates this spillage problem is the act of wiping the bristles of the paint brush on the inside of the can to remove excess paint therefrom. Still another problem encountered by painters is the need to add thinner or mix with other colors to obtain the desired shade of paint. This requires pouring into another container because of inadequate capacity of the original container. The pouring action again fills the groove on top of the container with liquid which interferes with the proper reapplication of the lid. Furthermore, an improperly sealed paint can dries out the contents therein so that it becomes unusable.

The prior art has attempted to overcome these many difficulties by devising a variety of paint can attachments. Funnel-shaped attachments have served to increase the capacity of paint cans. However, since many of these devices only snap onto the outside of the rim of the paint can, paint has still been found to contaminate the internally exposed edge of the rim with the concurrent trapping of paint in the closure groove.

Accordingly, the present invention provides a device which has the dual function of a rim guard and an extension, which can be removably secured to the rim of a container. Said unitary device is reusable and can be inexpensively produced from any suitable plastic material, such as polyethylene or other resilient material, and comprises a tubular member provided with an annular flange at its lower end which completely embraces or encloses the rim of an open can, a portion thereof extending into the internal part of the can, and a portion thereof snapping onto the outside of the can, said outside portion being further provided with an upwardly extending flange which forms a catch basin for any paint drippings. The wall of the tubular member at its uppermost edge may preferably be inwardly tapered to provide a scraping surface for removing excess liquid from the brush and insure that said liquid flows back into the can.

More specifically, instant invention provides a rim guard and extension device adapted to be removably secured to the rim of an open container comprising a tubular member provided at its lower end with an integral annular flange extending radially and horizontally and consisting of a downwardly-extending vertical internal member for insertion into said container and engagement with the inner edge of said rim, a horizontal bridge member for disposal on said rim and a downwardly-extending vertical external member for engagement with the outer edge of said rim, said annular flange being additionally provided at its outer edge with an upstanding flange which forms an annular catch basin.

Therefore, it is a principal object of instant invention to provide both an extension and rim guard as a unitary device which can be removably secured to and embraces the rim of a container, thereby keeping the sealing groove thereof free of liquid drippings so as to enable resealing with original container lid.

Another object of instant invention is to provide for additional container space for mixing and/or adding liquid.

Still another object is to provide for easier pouring therefrom and keeping the sealing groove clean during this operation.

Another object is to provide a catch basin for excess drippings so that the sides of the container are kept clean.

Another object is to provide a device which can be cleaned and reused numerous times.

Still another object is to provide an improved device applicable to all types of containers, particularly paint cans, regardless of deviations in shape and size from standard size cans.

In accordance with the above objects and such other objects and features which will become apparent from the following specification, the invention will be understood from the accompanying drawings, wherein like characters designate like parts and wherein:

FIG. 1 is a top plan view of the container rim guard and extension device of instant invention;

FIG. 2 is a sectional view taken along line 2—2 of FIG. 1; and

FIG. 3 is a cross-sectional view, shown in connection with an open container.

Referring to the drawings in detail, the container rim guard and extension device of this invention comprises a tubular member 1, integrally attached to an annular flange 2, which extends radially and horizontally from the lower end 3 of tubular member 1, and completely embraces or surrounds grooved rim 4 of an open container 5 by means of downwardly-extending internal member 6, which is inserted into container 5, and a downwardly-extending external member 7 which cooperatively engages bead member 8 of container 5. Internal member 6 is contiguous with tubular member 1.

Annular flange 2 is additionally provided at its outer edge with an upwardly extending flange 9 contiguous with external member 7, which forms an annular catch basin to keep the sides of the container clean and to retain any overflowing of the contents of container 5.

Annular flange 2 comprises horizontal bridge member 10, vertical internal member 6, and vertical external member 7, said internal and external members being suitably shaped to resiliently and firmly engage rims of containers which may deviate in size and/or shape from that of standardized containers (1 gallon paint can) or rims which may have become distorted during shipping and/or usage. As shown in FIGS. 2 and 3, internal member 6 is tapered downwardly at an obtuse angle 11 from bridge member 10, preferably at about 130°–140°, in order to firmly engage the inner edge of the rim of the container at any point along tapered internal member 6, in order to effect a tight fit and to prevent any of the contents thereof from contacting any portion of said container rim.

It may be desirable, although not neccesary, to provide an additional obtuse angle 12, of about 140°–108°, to supplement the downward tapering of tapered internal member 6, in order to fit containers which deviate in construction from the standard.

Similarly, external member 7 is slightly thicker at its peripheral portion and forms an inwardly directed bead 14 to further make for a secure and tight seal between bead member 8 at the outer edge of rim 4 of container 5 and external member 7 of instant novel device, to protect the rim from becoming contaminated with liquid such as paint from the container. Bead 14 of external member 7 snap locks onto container 5 due to the resiliency and semi-flexible nature of the plastic construction of instant device.

Tubular member 1 preferably tapers gradually inwardly and upwardly toward its top, although tubular member 1 may also extend directly vertically towards its upper opening 15. The upper edge 16 of tubular member 1 tapers or slopes inwardly, preferably at about a 10° angle, to afford an inwardly slanting surface on which to wipe a paint brush so that the excess paint flows back into the container. The inner wall of tubular member 1 may be angled, as at 17 in FIG. 2, when tubular member 1 tapers inwardly and upwardly to afford an upper wall of sufficient thickness and strength.

To utilize this novel device, bridge member 10 of annular flange 2 is positioned on rim 4 of open container 5 with vertical internal member 6 inserted into container 5 to cooperate with the inner edge of rim 4 and vertical external member 7 is forced downwardly over bead 8 so as to snap into place and engage the outer edge of rim 4. Another method of attaching this device to the open rim of a container is to place annular flange 2 on rim 4 of container 5 and force downwardly so that both vertical internal member 6 and vertical external member 7 simultaneously embrace rim 4 by snap-locking onto bead 8. Regardless of the structure of rim 4 of the container, tapered internal member 6 will bear tightly against the inner edge of rim 4 and preclude passage of paint to rim 4. Thus, it is apparent that both the inner edge as well as the outer edge of rim 4 is completely surrounded and protected from contact with the liquid contents, with bridge member 10 affording complete protection to the closure groove normally found on paint cans and the like.

It will be readily appreciated that, with this device attached to a paint can, pouring paint out therefrom or adding paint thereto, can be easily accomplished without getting the rim of said can covered with wet paint. In addition, the side-walls of the paint can are kept free of overflow paint assisted by upwardly extending flange 9 which forms a catch basin with horizontal annular flange 2.

The container rim guard and extension device according to this invention has been found to greatly reduce the wasting of paint which normally occurs during the painting operation and in the storage of partially-used paint. By keeping the rim of a paint can free of paint, the reapplication of the original press-on lid is facilitated for reuse of the paint at a later date.

Instant device can be inexpensively and simply manufactured by molding as a unitary unit from a suitable semi-flexible and resilient plastc material such as polyethylene or similar material. Instant unitary device is designed to be detachably attached to the open rim of a container with facility, particularly a paint can, and can be reused innumerable times.

Although this invention has been described with reference to specific embodiments, it will be apparent to one skilled in the art that various modifications and equivalents may be made thereto which fall within the scope herein.

What is claimed:

1. A rim guard and extension device adapted to be removably secured to the rims of open containers, comprising a tubular member provided at its lower end with an integral annular flange extending radially and horizontally outwardly, wherein the upper edge of the wall of said tubular member tapers inwardly, and a downwardly-extending vertical internal member contiguous with said tubular member for insertion into said container and engagement with the inner edge of said rim, said vertical internal member being tapered downwardly and outwardly at an obtuse angle from said annular flange in order to securely engage the inner edge of various rims of slightly different sizes and shapes, and said annular flange being provided at its outer edge with a circumferentially continuous downwardly-extending vertical external member for engagement with the outer edge of said rim, said annular flange being additionally provided at its outer edge with a circumferentially continuous upstanding flange which is contiguous with said vertical external member and forms an annular catch basin.

2. The rim guard and extension device in accordance with claim 1, wherein the vertical external member is provided with an inwardly directed bead at its periphery which snaplocks onto the bead portion at the outer edge of said rim.

3. The rim guard and extension device in accordance with claim 1, wherein the tubular member tapers inwardly and upwardly toward its top.

4. The rim guard and extension device in accordance with claim 1, which a semi-flexible, unitary, reusable device.

* * * * *